US005860869A

United States Patent [19]

Duncalf

[11] Patent Number: 5,860,869

[45] Date of Patent: Jan. 19, 1999

[54] BALLISTIC IMPELLER GOLF CLUB WITH SAFETY HANDLE

[76] Inventor: D James Duncalf, 1204 Hollenbeck Ave., Sunnyvale, Calif. 94087

[21] Appl. No.: 891,487

[22] Filed: Jul. 11, 1997

[51] Int. Cl.[6] ..... A63B 69/36

[52] U.S. Cl. ..... 473/131; 473/282; 473/329

[58] Field of Search ..... 473/324, 329, 473/332, 333, 131, 282; 124/16, 45, 52, 7

[56] References Cited

U.S. PATENT DOCUMENTS

| | | | |
|---|---|---|---|
| 769,939 | 9/1904 | Clark . | |
| 4,170,357 | 10/1979 | Greer . | |
| 5,522,594 | 6/1996 | Taylor et al. | 473/171 |

FOREIGN PATENT DOCUMENTS

| | | |
|---|---|---|
| 1181539 | 6/1959 | France . |

*Primary Examiner*—William M. Pierce

*Attorney, Agent, or Firm*—Robert Samuel Smith

[57] ABSTRACT

An impeller golf club of the type having a piston with a face plate mounted on the club head which stikes a golf ball when a cartridge in the club head is detonated wherein the improvement is a safety feature which prevents the cartridge from being detonated unless the club is positioned in substantially the required position for striking the ball. The safety feature includes three balls, each free to roll in its own groove. Any one of the balls may interfere with actuating depression of the trigger button unless the club is located in the safe range of positions. The cartridges are retained in a cartridge holder that is insertable in the club head and secured by a cam that is released by the user turnng a cam handle.

7 Claims, 8 Drawing Sheets

BALLISTIC IMPELLER GOLF CLUB WITH SAFETY HANDLE

FIELD OF THE INVENTION

This invention relates to golf clubs and in particular to an impeller golf club powered by an explosive cartridge that will not detonate unless the ball is positioned to hit the ball.

BACKGROUND OF THE INVENTION

The game of golf uses clubs which are swung into contact with the golf ball to provide the necessary energy to impel the ball down the fairway. Many people who would otherwise enjoy golf are not capable of physically swinging the club hard enough to participate in the sport. In particular, many people who are capable of using a putter are not capable of driving the golf ball a significant distance from the tee to the green.

In the past, others have tried unsuccessfully to solve this problem by inventing clubs which generate impelling force against the ball, independent of energy imparted by swinging the club. These attempts have failed because the club must be swung against the ball.

U.S. Pat. No. 5,522,594 to Taylor and Duncalf disclose a different approach. The player assumes the normal stance for driving the ball and places the club against the ball. The head of the club has a piston plate that strikes the ball when the user presses a button on the handle which detonates a cartridge behind the piston in the club head. The ball is thereby driven down the fairway without the player having to swing the club. This patent is hereby incorporated as reference into this application.

In spite of the major advance in the art disclosed by U.S. Pat. No. 5,522,594, a significant problem remains regarding the safety of using the club. The problem is the possibility that the cartridge may fire when the club is not in a position to strike the ball. Such a situation might occur when the user might not realize that when returning the club to the golf bag, the club may be cocked and ready for firing. Another situation might be if a child were to play with the club and have it accidentally fire.

Another characteristic of the club of the prior art (disclosed in U.S. Pat. No. 5,522,594) is that a mechanism for securing a cartridge holder in a breech chamber includes a spring loaded latch pin that bears down and captures the cartridge holder. Removal and insertion of the cartridge holder into a club head with this mechanism is more inconvenient than the construction according to the present invention. Furthermore, springs wear and lose their resiliency so that reliability of the spring based mechanism diminishes with use.

SUMMARY

The general object of the invention is to provide a ballistic impeller golf club that is capable of accurately driving a golf ball a controllable distance down the course without the necessity of swinging the club.

Another object is to create a ballistic impeller golf club that is superficially similar to a conventional golf club in appearance, is lightweight and fits easily into a conventional golf bag.

Another object of the invention is to create a ballistic impeller golf club of sturdy construction capable of withstanding rough handling over a long period of time.

It is another object to create an impeller golf club energized by detonating a cartridge that has a safety feature that prevents detonating unless the club is positioned in an orientation which is customary for driving the ball.

It is another object that a mechanism be provided for retaining the cartridge holder in a breech chamber with a force that is not spring based.

These and other objects of the invention will be apparent to those skilled in the art from a detailed description of the preferred embodiment of the invention below.

DETAILED DESCRIPTION OF PREFERRED EMBODIMENTS

Figure 1:
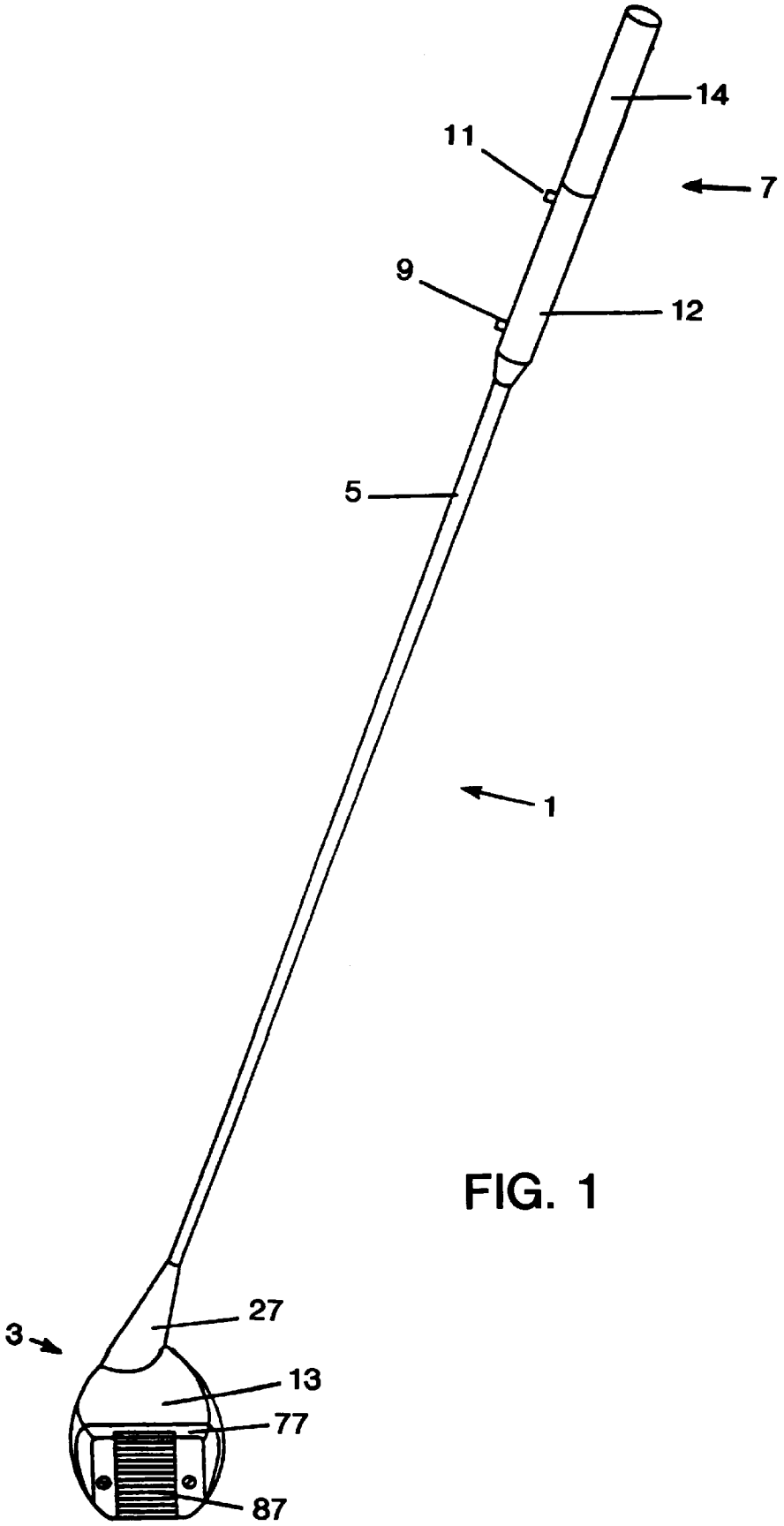
FIG. 1 shows a perspective overall view of the ballistic golf club.

Turning now to a discussion of drawings, FIG. 1 shows the ballistic impeller golf club 1 having a club head 3, a hollow shaft 5 fixed to the club head 3 extending upwardly and slightly outwardly from the club head 3. and handle assembly including trigger button 9, safety button 11 and rubberized handle covers 12 and 14. Club head 3 includes piston housing 13, club face 77 strike plate 87 and firing pin housing 27. Club head 3 includes piston housing 13. Club head 3 is preferably made of aluminum or stainless steel and is of a mass calculated to counteract the recoil in the impelling cycle.

Figure 2:
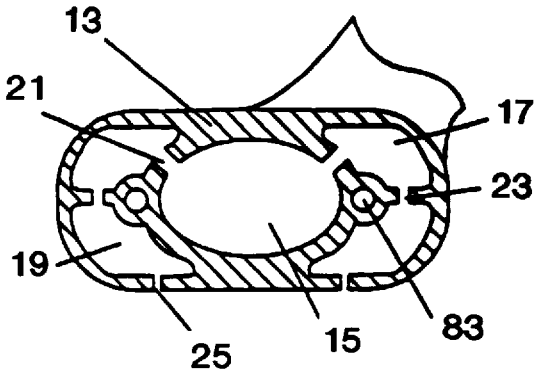
FIG. 2 shows a cross section of the piston housing.
Figure 4:
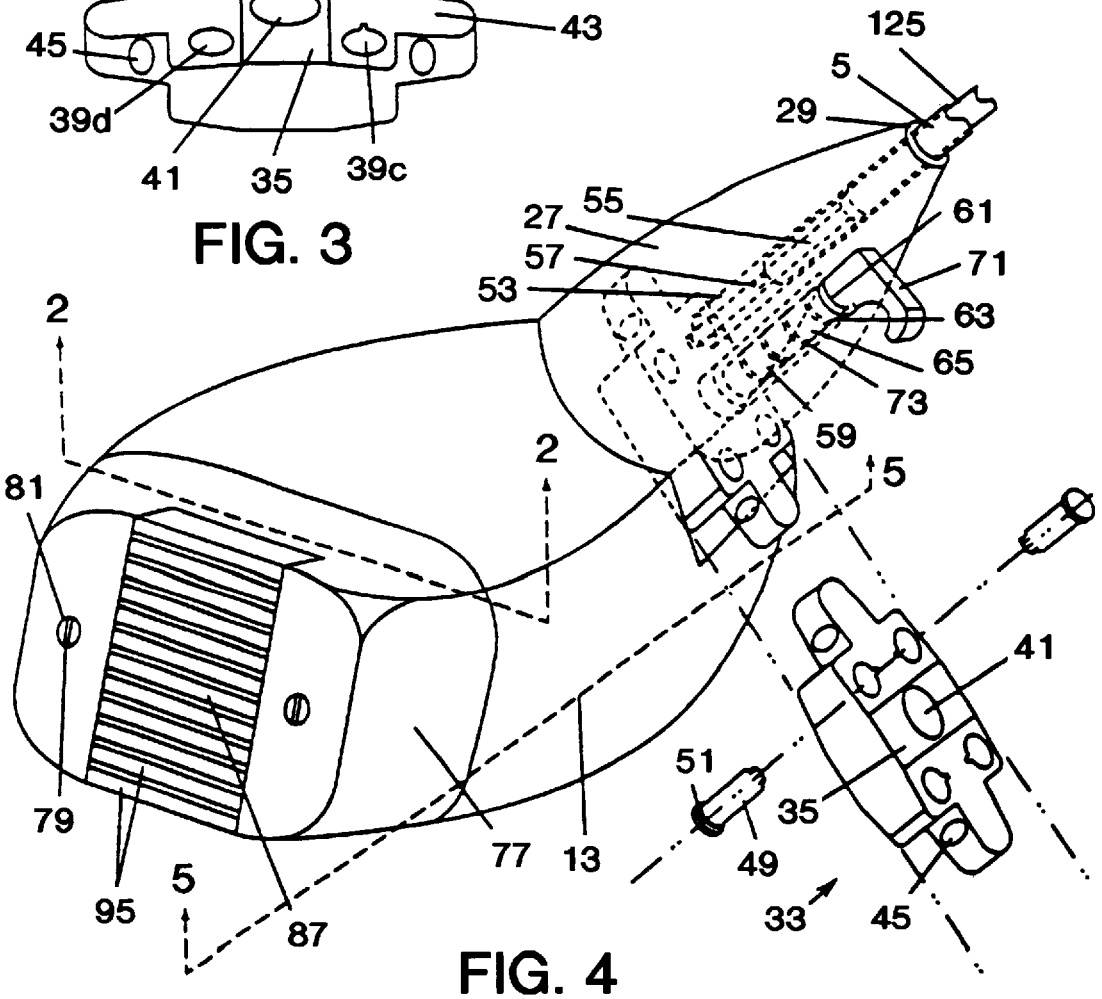
FIG. 4 shows a front quarter perspective view of the golf club head.
Figure 6:
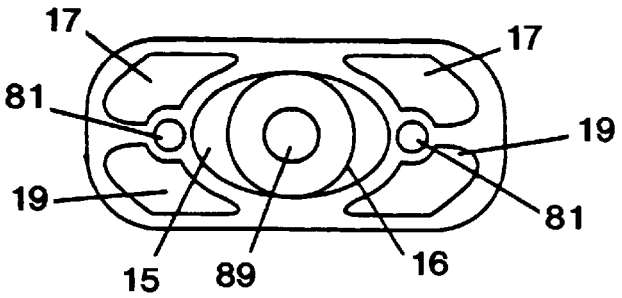
FIG. 6 shows a perspective view of the front face piece of the golf club head.

Referring to FIGS. 2, 4 and 6 in a preferred embodiment, piston cylinder 15 has an oval cross section. In an alternate embodiment, piston cylinder 15 could have a circular or square cross section. Also formed in club head 3 are four silencer chambers comprising two silencer chambers 19 on each side of piston cylinder 15 and two silencer chambers on lower silencer chambers 19 on each side of piston cylinder 15. Gas communication is possible between piston cylinders 15 and upper silencer chambers 17 through cylinder discharge ports 21 and between each lower silencer chamber and finally between each lower silencer chamber 19 and the exterior of club head 3 through lower silence discharge ports 25. In a preferred embodiment the various discharge ports are channel shaped but may also be oval or circular. Alternate embodiments could include more or less silencer chambers.

Figure 5:
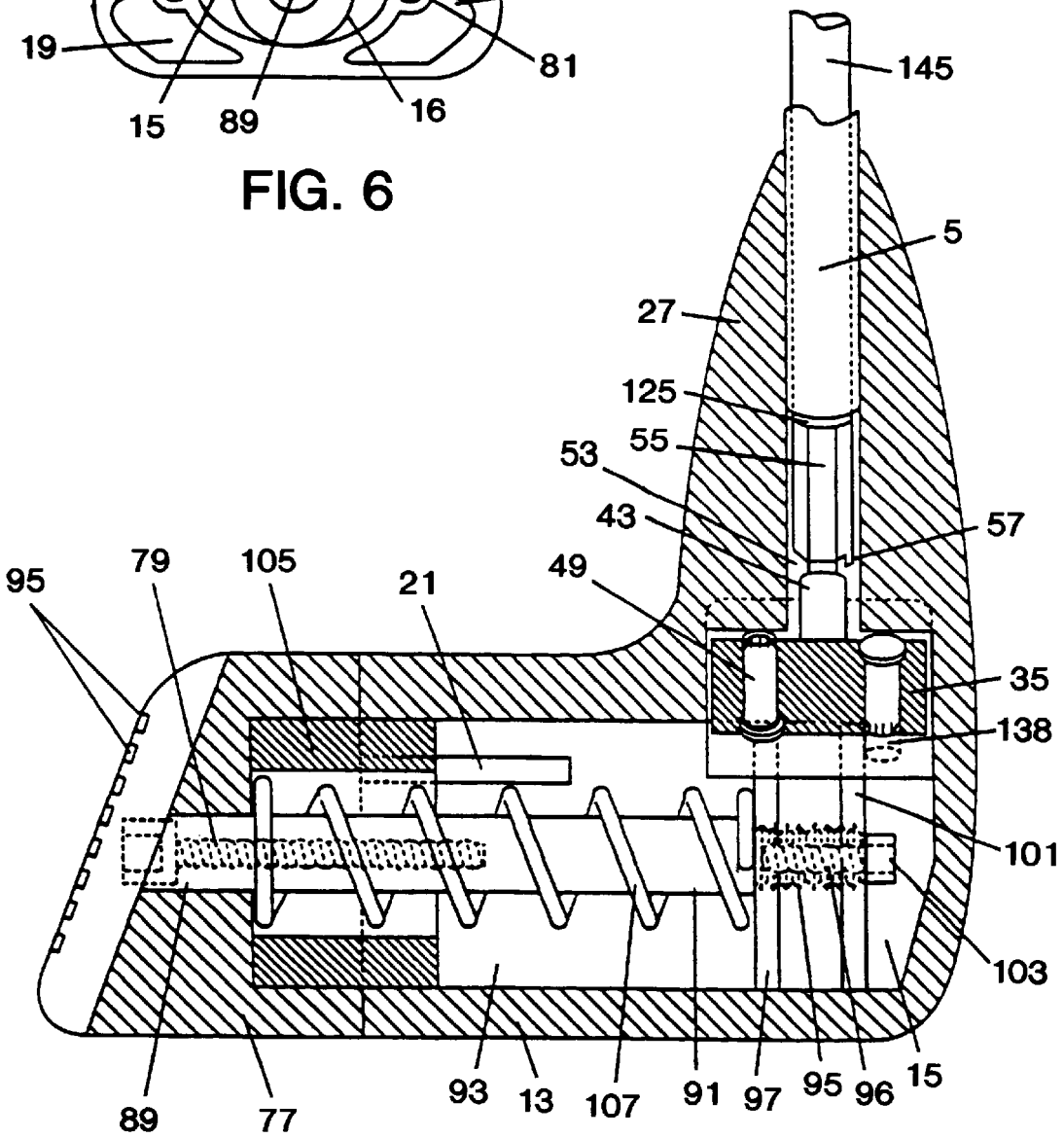
FIG. 5 shows a sectional view of the golf club head.

Club face 77 is removably coupled to piston housing 13 in a preferred embodiment shown in FIGS. 4 and 5 by screws 79 which are received in the face mounting screw holes 81 and threaded into club face mounting screw holes 83. Club face 77 further includes strike plate channel 85 for receiving strike plate 87 when strike plate 77 is in ready position and piston guide hole 89 for receiving piston rod 91. Piston rod 91 is preferably cylindrical but could otherwise be square or oval or have an other shaped cross section. In a preferred embodiment, shallow grooves 95 are machined into the front of strike plate 87. It is anticipated that a set of ballistic clubs will include at least three clubs with one having face 78 cut at a variety of angles with the vertical, a second cut and a third cut at a variety of angles from vertical.

Referring to FIG. 5, piston 93 comprises piston rod 91 having an outer end. The outer end of piston rod 91 extends from inside piston cylinder 15 through piston rod guide hole 89 in club face 77. Piston rod guide hole 89 is large enough to slideably receive piston rod 93 and to restrict the motion of piston rod 93 to axial back and forth travel. Strike plate 87 is fixed to the outer end of piston rod 93. The inner end of piston rod 91 includes a threaded end portion 95, and a threaded recess 96. Piston spring bearing member 97 and piston seal ring 99 are threadably coupled to the threaded end of piston rod 91 with piston spring bearing member closest to the front face 77 of club head 3. Piston crown 101 is coupled to the inner end of piston rod 91 by screw 103 threadably coupled in threaded recess 95. Piston seal ring 99 is preferably composed of high impact plastic, nylon, or teflon.

Figure 3:
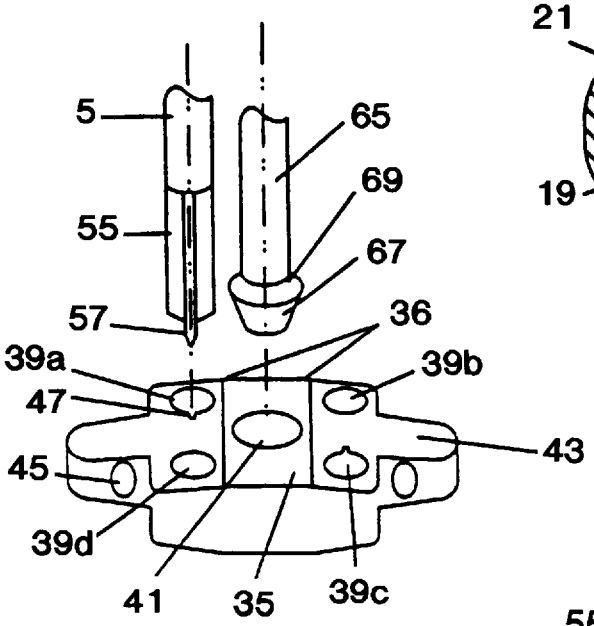
FIG. 3 shows a perspective view of the cartridge holder.

Piston snubber marshmellow ring 105 is placed in circular recess 16 in the forward end of piston cylinder 15 of club face 77. Helical compression piston return spring 107 is engaged over and around piston rod 91 with one end of piston return spring 107 passing through piston snubber marshmellow ring 105 and engaging against club base 77, and the other end engaging piston spring bearing member 91. Piston return spring 107 need not be attached to either club face 77 or piston spring bearing member 91 because its inherent spring force will tend to hold it engaged with these shoulders. When fired, piston 93 is urged forward in cylinder 15 by expanding gas, thereby compressing piston return spring 107 and moving strike plate 87, impelling the golf ball down the course. Piston snubber marshmallow ring 105 and piston return spring 107 decelerates piston 93 and the compressed spring energy stored in piston return spring 107 urges piston 93 back to ready position. Club head 3 also comprises a firing pin housing 27 protruding upwardly and slightly outwardly from piston housing 13, tapering to form firing pin housing tip 29 to which hollow shaft 5 is attached. In a preferred embodiment shown in FIG. 4, a rectangular breech chamber 31, having injection port 32 allowing gas communication between breech chamber 31 and piston cylinder 15 is formed within piston housing 13 at the junction between piston housing 13 and firing pin housing 27 for receiving cartridge holder 33. Breech chamber 31 is preferably cut approximately 33° angle from horizontal with the lowest side open. In a preferred embodiment shown in FIG. 3 and 4, Cartridge hold 33 is rectangular having a top surface 35, shown, and an identical bottom surface. Cartridge holder 33 is preferably made of nylon, aluminum, or other material calculate to withstand the force of the expanding gas generated by detonation of cartridge round 49. Four cartridge containment holes 39*a*, 39*b*, 39*c*, and 39*d* extended through cartridge hole 33 from the top surface 35 to the bottom surface, with one containment hole 39 in each corner of cartridge holder 33. Cartridge holder 33 further includes cartridge holder detente 41 in the center of cartridge holder 33 on both the top and bottom surfaces of cartridge holder 33 and two vertical flanges 43 on each short side of cartridge holder 33, having thumb grips 45 formed therein. A slight angle is cut on each side of cartridge holder 33 from line 36 sloping downwardly toward vertical flanges 43 forming a sealing ramp on each side of both the top and bottom surfaces. A matching ramp is cut in then upper surface of breech chamber 31, whereby when cartridge holder 33 is inserted in breech chamber 31 cartridge containment hole aligned with firing pin 57 is tightly sealed against injection port 138. Cartridge containment holes 39*a* and 39*c* include a firing detente 47 formed in the top surface 35 of cartridge holder 33. The cartridge containment holes 39*b* and 39*d* have identical firing detentes 47 formed in the bottom surface of cartridge holder 33.

In a preferred embodiment .222 caliber cartridge rounds 49 are inserted in each cartridge containment hole 39*a*, 39*b*, 39*c*, and 39*d*, with the cap 51 of each cartridge round 49 positioned on the side of cartridge holder 33 having the firing detente 47 for that cartridge containment hole 39*a*, 39*b*, 39*c*, or 39*d*, best seen in FIG. 2. In alternate embodiments larger or smaller caliper cartridge rounds may be used. The Cartridge rounds used in the present invention are low velocity loads manufactured by Winchester arms Co., however, a variety of other suitable cartridge rounds may be obtained from other sources.

Returning to firing pin housing 27, in the preferred embodiment, a hexagonal bore 53 extends from firing pin housing tip 29 into breech chamber 31. A hexagonal firing index pin 55 with a smaller diameter than hexagonal bore 53 is slideably received in hexagonal bore 53, and firing pin 57 is fixed to the lower end of firing index pin 55, whereby firing pin 57 is aligned, when cartridge holder 33 is inserted in breech chamber 31, with both firing detente 47 and with cap 51 of one of cartridge round 49. Hexagonal bore 53 is large enough to restrict the motion of hexagonal index pin 55 through axial up and down travel through hexagonal bore 53. In alternate embodiments hexagonal bore 53 can be circular, square, or any other shape.

In the preferred embodiment cartridge round 49 is rim shot. Rim shot rounds are detonated when the firing pin hits the rim of cap 51 of cartridge round 49. In an alternate embodiment, cartridge round 49 can be center shot. Firing pin 57 would then be aligned with the center of cap 511 of cartridge round 49.

Firing pin housing 27 further includes latch pin bore 59 extending from the exterior surface of firing pin housing 27 into breech chamber 31. Latch pin bore aperture 61 on the exterior surface of firing pin housing pin 27 has a diameter smaller than the diameter of latch pin bore 59 thereby forming upper helical latch pin spring shoulder 63. Fixed to the lower end of latch pin 65 is cartridge holder latch 67 having a circumference slightly smaller than the circumference of cartridge holder latch pin bore 59, but larger than the circumference of latch pin 65, thereby forming lower helical latch spring shoulder 69, best seen in FIG. 3.

Cartridge holder latch 67 tapers from its largest diameter at lower helical latch spring shoulder 69. Latch pin 65 is slideably received in latch pin bore 59 and extends through latch pin bore aperture 61. Latch pin release handle 71 is fixed to the protruding end of latch pin 59. Latch pin 65 and cartridge holder latch 67 are sized so that movement is restricted to up and down axial travel through latch pin aperture 61 and latch pin bore 59.

Helical compression spring 73 is engaged over and around latch pin 59 with one end of helical compression spring engaging lower helical latch spring shoulder 69, and the other end engaging upper helical latch spring shoulder 63. Helical compression spring 73 need not be attached to either helical latch spring shoulder 63 or 67 because its inherent spring force will tend to hold it engaged with these shoulders. The inherent spring force of helical compression spring 73 will also tend to urge the tapered end of cartridge holder latch 67 into cartridge holder detente 41, thereby removably coupling cartridge holder 33 in breech chamber 31 with one of cartridge containment holes 39*a*, 39*b*, 39*c* or 39*d* aligned with firing pin 57 above cartridge holder 33, and with injection port 32 below cartridge holder 33. Cartridge holder 33 may be rotated along a vertical or horizontal axis prior to insertion into breech chamber 31 in order to align any one of cartridge containment holes 39*a*, 39*b*, 39*c*, or 39*d* with firing pin 57 and injection port 32.

Figures 7, 8, 9:
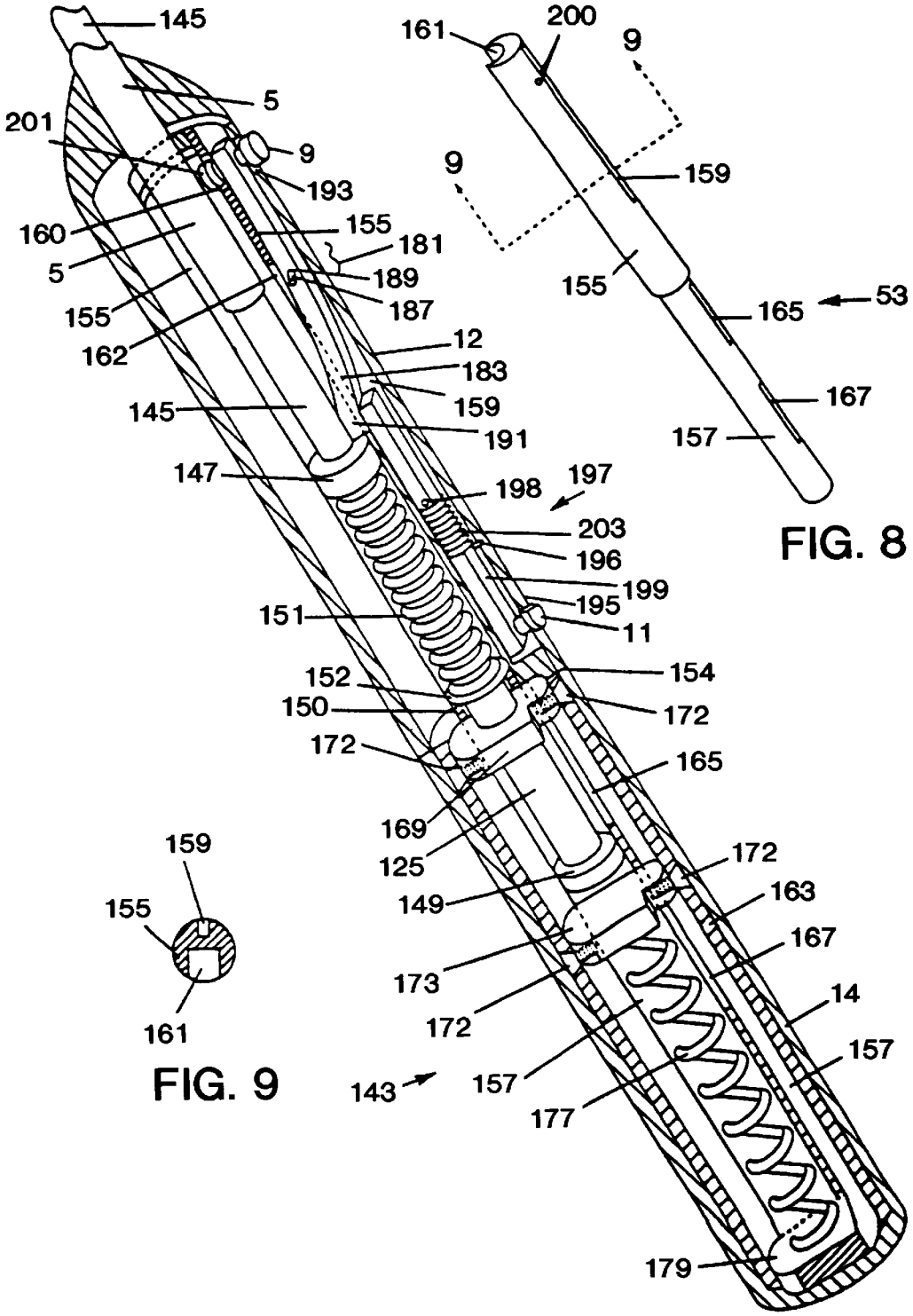
FIG. 7 shows a sectional view of the handle assembly.
FIG. 8 shows a perspective view of the handle assembly.
FIG. 9 shows a sectional view of the handle member.

Refining to FIGS. 7,8,9 elongated hollow shaft 5 is fixed at the end opposite club head 3 to handle assembly 7. Handle assembly 7 includes handle member 153, having a forward member section 155 of a given diameter, a real member section 157 a smaller diameter and a spring channel 161 running the length of handle member 153, best seen in FIG. 9.

Forward member section 155 of handle member 153 includes trigger and safety groove 159 including trigger spring slot 160 and trigger slot 162. Rear member section 157 includes forward cocking pawl slot 165, and rear cocking pawl slot 167. The diameter of spring channel 161 abruptly narrows forming filing pin linkage spring shoulder 150, and abruptly widens again resuming its previous diameter firing pin linkage 145 slideably received in hollow shaft 141. Firing pin linkage 145 includes trigger shoulder 147 and firing pin head 1149, each having a larger diameter than firing pin linkage tube 145. Helical compression firing pin spring 151 is engaged over and around firing pin linkage tube 145 having one end engaged with trigger shoulder 147 and the other engaged with flat washer 152 and filing pin linkage spring shoulder 150.

Rear member section 157 is slideably received in cocking handle sleeve 163, having an internal diameter larger than the diameter of real member section 157. Forward cocking pawl 169, having a forward cocking pawl 171, is slideably received in rear member section 157 with forward locking pawl tab 171 extending through forward cocking pawl slot 165. Rear cocking pawl 173 is shaped substantially similar o forward locking similar to forward cocking pawl 169, having real cocking pawl tab 175,and being slideably received in rear member section 157 with real cocking pawl tab 175 extending through rear cocking pawl slot 167. Forward cocking pawl 169 and real cocking pawl 173 are fixed to locking handle sleeve 163 by means of cocking pawl screws 172. Helical compression cocking handle return spring 177 is received within handle member 153 with one end engaged with rear wall 179 of handle member 153 and the other engaged with rear cocking pawl 173. Cocking handle return spring 177 need not be attached to rear wall 179 of handle member 153 or with rear cocking pawl 173 because its inherent spring energy will tend to keep it engaged with these members.

Rubberized handle covers 12 and 14 cover forward member section 155 and cocking handle sleeve 163 respectively, and butt together at 154. Handle 12 has rubberized handle grip hole 193 through which trigger button 9 extends, and rubberized handle grip slot 195 through which safety button 11 extends.

Trigger mechanism 181 includes trigger member 183 having trigger button 9 attached to the upper surface at forward end of trigger member 183 and pivot pin 187 which passes through trigger member 183 at pivot point 189. Trigger member 183 is arched slightly so that trigger member lever end 191 passes through trigger slot 162 to engage trigger shoulder 147. Each side of trigger pivot pin 187 is received in pivot holes 200 of handle member 153. Helical trigger compression spring 201 passes through trigger spring slot 161 and is engaged with hollow shaft 5 at one end and at the other end is engaged beneath trigger member 183 in substantial proximity to trigger button 7.

Safety mechanism 197 comprises safety member 199 having attached safety slide button 11, and helical safety return spring 203. Safety return spring 203 engages safety pin 198 at one end, and snap ring 196 at the other end.

In cocked position, trigger member lever end 191 is engaged with trigger shoulder 147. Safety member 199 engages trigger member lever 191 preventing release of trigger shoulder 147 and consequently release firing pin linkage 145.

The firing mechanism is cocked by pulling cocking handle sleeve 163 back away from club head 3, causing forward cocking pawl 169 to engage firing linkage head 149 and pulling firing linkage 145 back away from club head 3 until trigger shoulder 147 passes trigger member lever 191. Trigger member lever end 191 is urged downwardly against firing linkage 145 by trigger compression spring 201. Safety member 199 is pushed forward to engage trigger member lever 191, preventing release of trigger shoulder 147. Cocking handle return spring 177 urges cocking handle sleeve 163 back to ready position.

Figure 10:
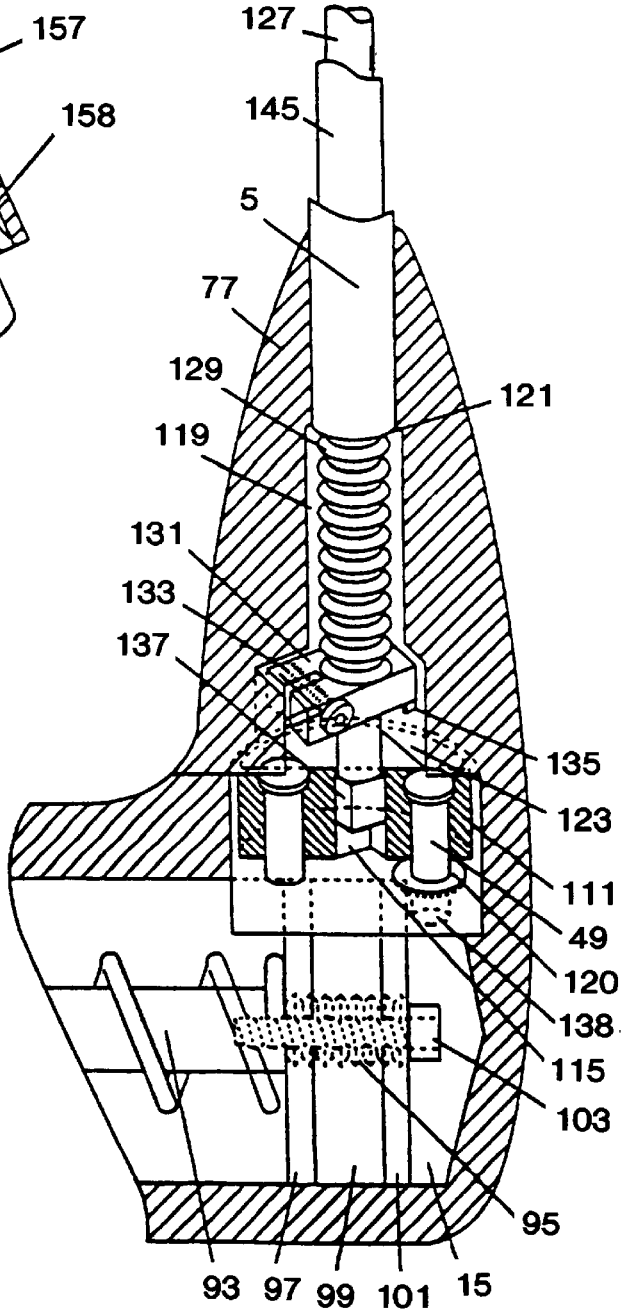
FIG. 10 shows a partial sectional view of the an alternate embodiment of the club head.
Figure 13:
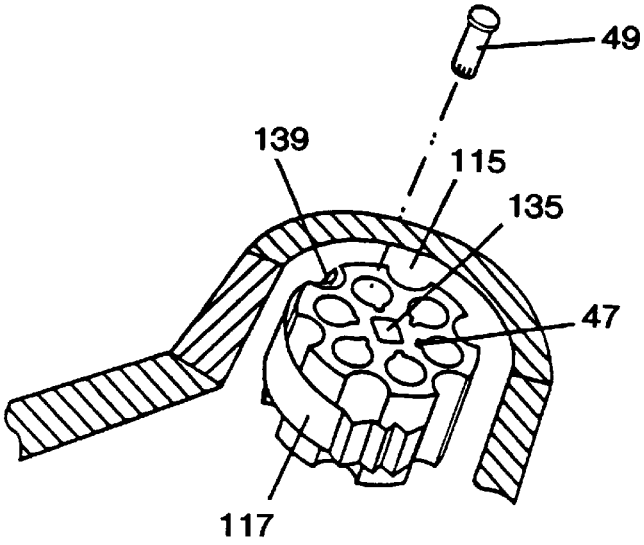
FIG. 13 shows a partial sectional perspective view of an alternate golf head embodiment. The ejection and alignment spring shaped cartridge holder are shown.
Figure 12:
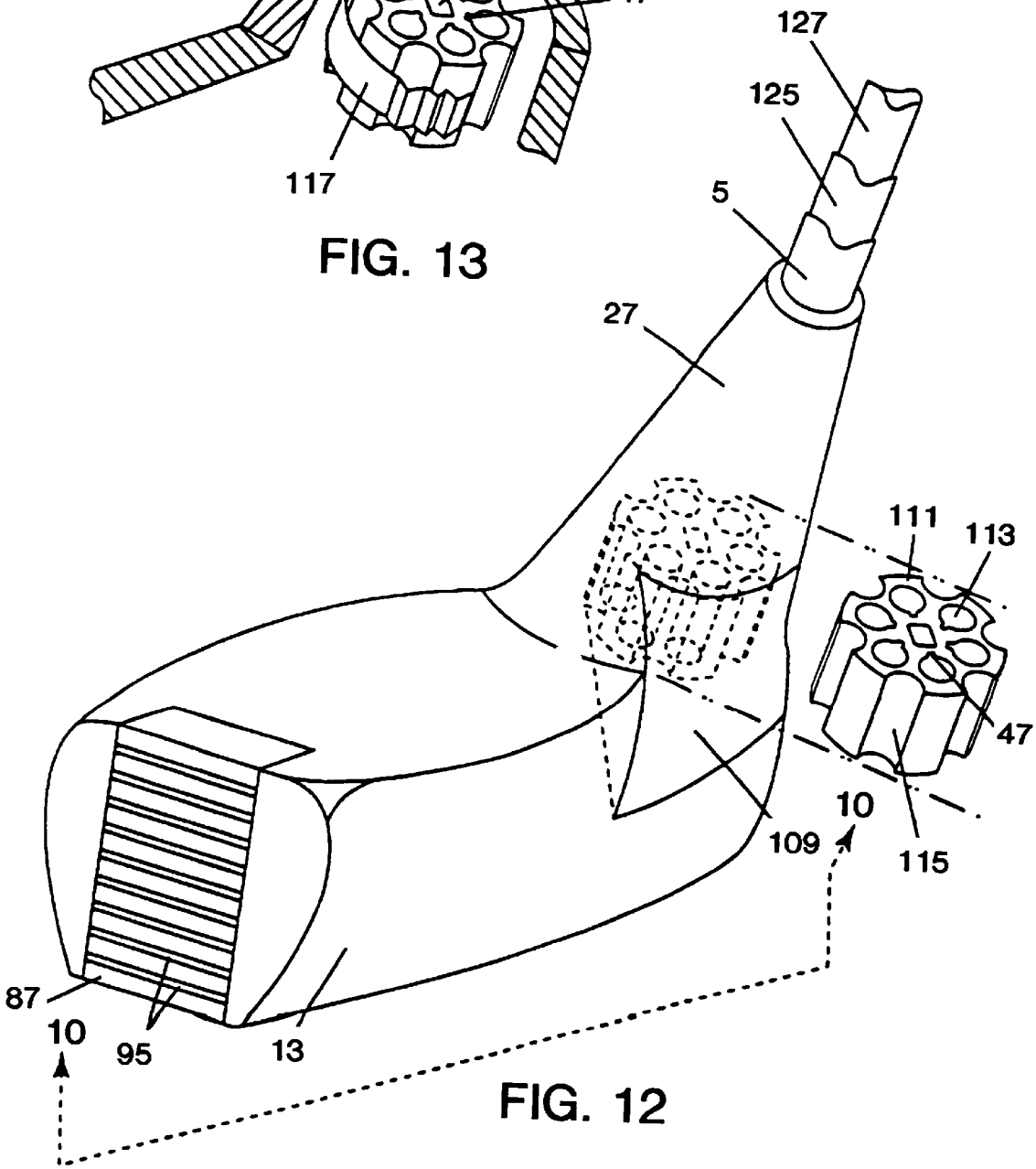
FIG. 12 shows a perspective view of an alternate golf head embodiment showing the disk-shaped cartridge holder being inserted into the beach.

In an alternate embodiment of the firing mechanism, best seen in FIG. 10, 12, and 13, a U-shaped breech chamber 109 rather than the square shaped breech chamber 31 of the prior embodiment is formed within piston housing 13 at the junction between piston housing 13 and firing pin housing 27 for receiving disc shaped holes 79.

In this alternate embodiment, a circular cross section bore 119, rather than the hexagonal bore 53 of the preferred embodiment, extends from firing pin housing tip 29 to rectangular cross section firing pin chamber 123. the diameter of bore 119 abruptly increases, forming an upper firing pin shoulder 121.

One end of tubular elongated hollow shaft 5 is fixed inside bore 119 with the end of hollow shaft 5 even with upper firing pin spring shoulder 121. Firing pin linkage 125 is tubular with an external diameter smaller than the internal diameter of elongated handle 5, and is slideably received in hollow shaft 5. Cylindrical cartridge index rod 127, having a diameter smaller than the internal diameter of firing pin linkage 125, and having a square index engagement spline 137 at one end, is slideably received within, and extends through firing pin linkage 125 past the end of firing pin linkage 125 into U-shaped breech chamber 109. Firing pin block clamp 131 is fastened onto the end of firing pin linkage 125 by tightening firing pin block clamp screw 133. Firing pin 135 is fixed to a lower corner of firing pin block clamp 125. Helical firing pin compression spring 129 is engaged over and around the portion of firing pin linkage 125, exposed in bore 119 and having one end engaging upper a firing pin spring shoulder 121 and the other end engaging firing pin block clamp 131. Firing pin compression spring 129 need not be fixed to either the filing pin, spring shoulder 121, or firing pin bock clamp 131 because its inherent spring energy will tend to keep firing pin compression spring 129 engaged with these members.

Referring to FIGS. 12 and 13, disc shaped cartridge holder 111 contains a plurality of cartridge containment holes 113 spaced apart on disc shaped cartridge holder 111, and extending entirely through cartridge holder 111. Six cartridge holes are preferred but more or less than six may be used. .222 caliber rounds 49 are inserted in each cartridge containment hole 113. All of the .222 caliber cartridge rounds 49 are oriented in the same direction. Disc shaped cartridge holder 111 contains channel notches 115, one channel notch 115 corresponding to each cartridge containment hole 113. Cartridge holder 111 also includes a square cross section index engagement notch 138.

Arched ejection and alignment spring 117, seen in FIG. 13, having a cartridge alignment loop 139 is fixed in U shaped breech chamber 109. Cartridge holder 111 is inserted into breech chamber 109 deforming ejection and alignment spring 117. Spring energy stored in ejection and alignment spring 117 tends to urge cartridge holder 111 out of breech chamber 109. Cartridge holder 101 is held in place in breech chamber 109 by insertion of index engagement spline 137 of cartridge index of 127 into index engagement notch 138. Engagement of cartridge alignment loop 139 of arched ejection and cartridge alignment spring 117 holds one .222 cartridge 49 and cartridge hole 111 in proper position with filing pin 135 and with injection port 32.

Cartridge holder 111 can be rotated around its vertical axis to align other cartridges 49 with firing pin 135 an injection port 32 by turning cartridge index rod 127 until alignment loop 139 engages the channel notch 115 corresponding to the next unfired cartridge 49.

Figure 11:
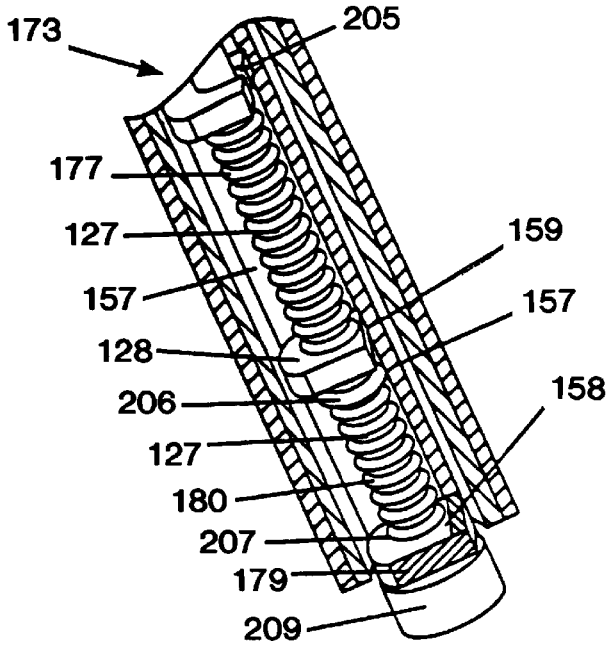
FIG. 11 shows a partial sectional view of an alternate embodiment of the handle assembly.

In this alternate embodiment, handle assembly 143 is also slightly different from that of the first preferred embodiment, as seen in FIG. 11. In this embodiment, firing pin linkage 145 not shown in FIG. 11 is tubular. The handle assembly end of cartridge index rod 127 extends through firing pin linkage tube 145 through rear pawl notch 205 of rear pawl 173, through the coils of cocking handle return spring 177 and out rear rear handle member wall hole 207 in rear wall 179 of handle member 153 forming index spring shoulder 158. Cocking handle return spring 177, engaged with retainer 128, is fixed in channel 161 of rear handle member 157. Knob 209 is fixed to end of firing pin index rod 127. By turning knob 209, firing pin index rod is turned thereby turning disc shaped cartridge holder 111 and thereby aligning new unfired cartridge 49 with firing pin 135. Helical compression cartridge index rod spring 180 is engaged at one end with cartridge index rod 127 by snap ring 206 fixed to cartridge index rod, and at the other end with index spring shoulder 158 cartridge index rod spring 180 need not be fixed to snap shoulder 158 because inherent energy tends to keep it engaged with both members.

Figure 14:
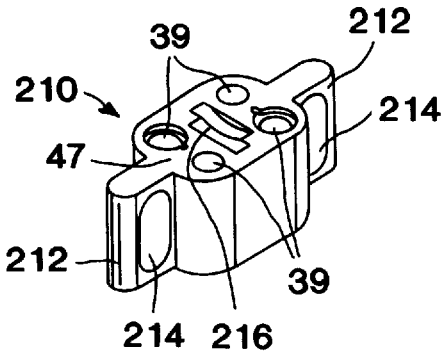
FIG. 14 shows the cartridge holder modified to accommodate a cam.
Figure 15:
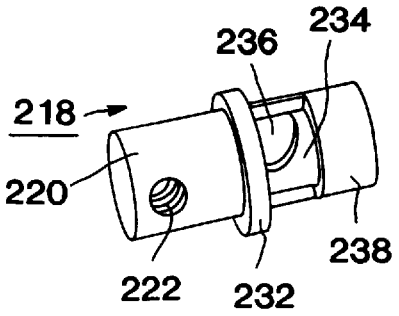
FIG. 15 shows the locking/blocking cam.
Figure 16:
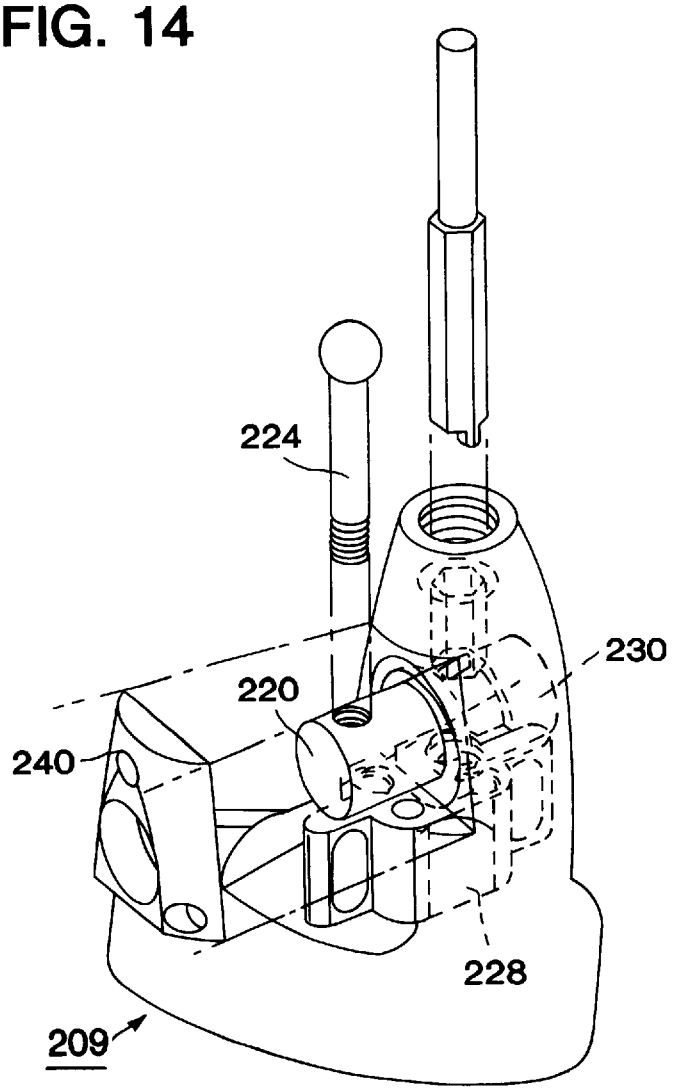
FIG. 16 shows the club head modified to accept the cam of FIG. 15.

FIGS. 14, 15, 16 show an alternate construction for locking the cartridge holder into the breach chamber.

FIG. 14 shows the cartridge holder 210 being a substantially rectangular section having a pair of flanges, one flange extending perpendicularly from one surface of the cartridge holder opposite another flange extending from an opposite side of the cartridge holder. Each flange has a depression 214 on each side providing a finger grip for inserting and withdrawing the cartridge from the breech chamber. Four cartridge containment holes 39 are shown, extending parallel to the flanges from a third side of the cartridge holder to the opposite side. Each cartridge containment hole has a firing detente 47. The third side also has a surface groove 216 which engages the cam shoulder of a locking/blocking cam shown in FIG. 15.

FIG. 15 shows the cam 218 having a cylindrical end 220 with threaded hole 222 into which a cam handle 224 (FIG. 16) is screwed. A cam shoulder 232 separates the cylindrical end 220 of the cam from a flat section 234 which has an aperture 236. End section 238 is cylindrical and joined to flat section 234 opposite cylindrical end 220.

FIG. 16 shows the club head with a breech chamber 228 (shown in phantom in FIG. 16) for slideably receiving cartridge holder 210. Cartridge holder 210 may be inserted into or withdrawn from the breech chamber 226 in club head 209 by the user grasping the appropriate flanges. Cartridge holder may be inserted into the breech chamber in any one of four orientations, each orientation corresponding to selecting one of four cartridges inserted into each cartridge containment hole. In use, the procedure is to load cartridges into all four cartridge containment holes and reorient the cartridge holder after each firing.

Adjacent to the breech chamber 228 in the club head 209 is a cam chamber 230 (shown in phantom in FIG. 16) for receiving the locking/blocking cam 218 of FIG. 15. Cylindrical section 238 rotatably mates with the cylindrical cam chamber 230. The cam 218 is retained in the cam chamber 230 by retaining plate 240 that is bolted to the club 209. Cylindrical end 220 extends from cam chamber 230 providing that cam handle 224 is accessible for clamping the cam in the required orientation in the cam chamber 230.

When the handle 224 is oriented as shown in FIG. 16, (parallel to the club shaft) the cam 218 is engaged with the cartridge holder 210 and the cartridge holder is locked in the chamber. When the cam handle 224 is oriented perpendicular to the club shaft, the cam shoulder 232 is disengaged from the cartridge holder 210 and the cartridge holder may be slid out of the breech chamber to select another cartridge chamber for firing.

When the cartridge is fired, the firing index pin passes through aperture thereby providing that cam handle cannot be withdrawn until the index pin is first withdrawn which requires that handle section 14 be withdrawn and locked in the safety position. As discussed above, the club can then be fired only after the safety button is depressed followed by depressing the trigger button.

An additional embodiment of the invention is a "tilt safety" feature that involves a construction of the handle which prevents firing the club when the handle is positioned in any orientation other than in the almost vertical inclination to drive a golf ball. In other words, according to this "tilt safety" embodiment, the cartridge will not fire when the club shaft is oriented in any position except when the shaft forms an angle that is any greater than 15 degrees from vertical.

Figure 17A:
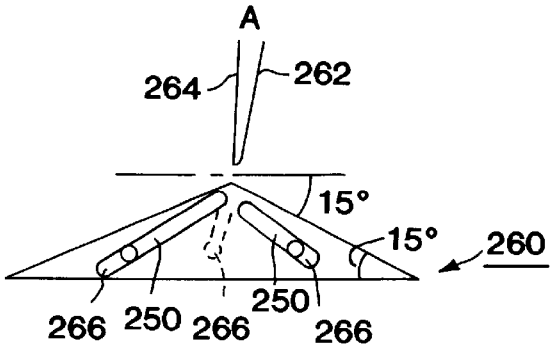
FIG. 17A is a perspective view and 17B is an elevation view of a cone, illustrating the tilt safety feature.
Figure 17B:
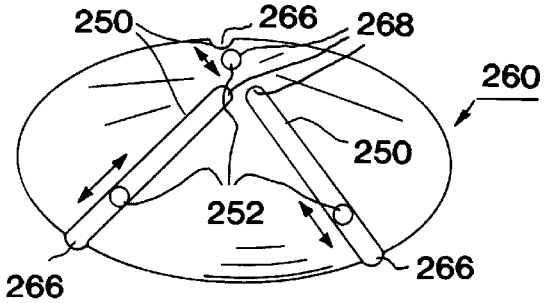

In order to illustrate the principle of the "tilt safety" modification, attention is directed to FIGS. 17*a* and 17*b*. FIG. 17*a* is an elevation view and FIG. 17*b* is a perspective view of a cone 260. The cone has three straight grooves 250 meeting at the apex of the cone 260.

The side of the cone makes an angle of 105 degrees with its axis. Each groove 250 contains a ball 254 which is free to roll from one end of the respective groove to the other. When the cone is positioned so that the angle A between the axis of the cone 262 and the vertical 264 is 15 degrees or less, each ball 254 will be positioned (roll to) the end of the respective groove distal from the cone axis. When the cone is tipped so that the angle A is greater than 15 degrees, at least one of the balls will roll to the other end of its groove toward the apex.

In the context of the present invention, the axis of the cone is coincidental with the axis of the club handle. Each of the three grooves is formed on the surface of the club handle frame. The three grooves are imposed corresponding to the three degrees of freedom of the club including an azimuthal angle and a longitudinal angle of the axis of the cone and a rotational angle of the club about the shaft. The three balls are captured in the three grooves by the rubber grip and the button.

Figure 18A:
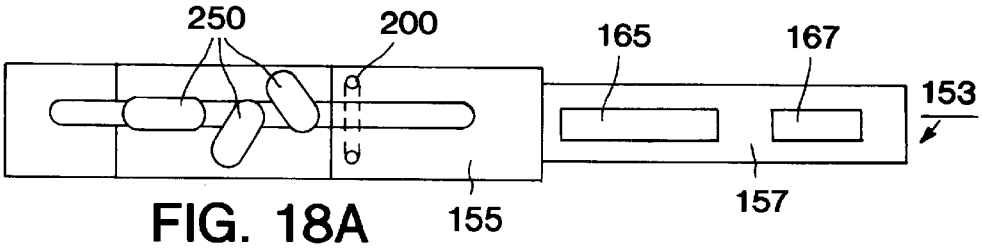
FIG. 18A is a plan view and FIG. 18B is an elevational view of the handle member showing grooves of the safety tilt feature.
Figure 18B:
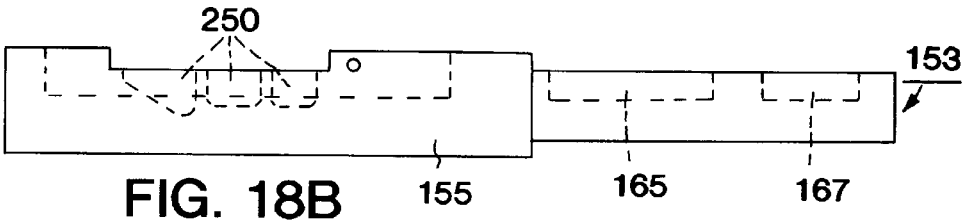

FIG. 18A is a plan view and 18B is an elevation view showing the modification of the handle member 153 by the addition of grooves 250 to incorporate the "tilt safety" feature. The three grooves 250 are spaced from one another along the handle member 153 so that none of the balls 252 will interfere with the other two balls, i.e., each ball 252 may occupy either end of its respective groove irrespective of the position of the other balls in their respective grooves. When the club handle is oriented at an angle with the vertical that is not greater than 15 degrees, all three balls will be located at an outer end of its respective groove corresponding to location 266 of FIGS. 17*a* and *b*. However, when the angle of orientation is greater than 15 degrees, at least one of the balls will roll to the other end 268 of its respective groove indicating "tilt".

Figure 19:
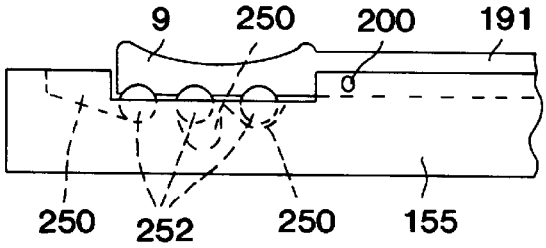
FIG. 19 is a view showing the trigger button interacting with the balls in grooves on the handle member.

As shown in FIG. 19, an extension of the trigger button extends over the "tilt" end of each groove so that when the club is tilted more than 15 degrees away from vertical, at least one of the balls will occupy the convex center location under the trigger button 9 and will prevent the trigger button 9 from being depressed and releasing the end of trigger lever 183 from engagement with trigger shoulder 147 (FIG. 7) thereby preventing detonation of the cartridge.

The ballistic impeller golf club is easily used. The sequence of operation of the ballistic ball impeller golf club is that a cartridge holder 33 is inserted having cartridge holder 49 of a chosen powder load. Different powder loads are available in .22 caliber cartridges sold by the manufacturer. The firing mechanism, as explained previously is cocked by pulling the cocking handle 16 back until the trigger lever end 191 engages the trigger shoulder 147.

Club head 3 is placed approximately one half inch behind the golf ball. The alignment of the strike plate is positioned with the longitudinal axis of piston rod 91 pointing toward the center of the golf ball. Safety button 11 is pulled back then subsequently trigger button 9 is pressed. Firing linkage 127 is thereby released and is urged downward by firing spring 151. Firing pin 157 contacts cartridge 49 detonating cartridge 49.

The hot gas from cartridge 49 expands and moves through injection port 32. Piston 93 is forced to the opposite end of piston cylinder 15 where the hot is vented through cylinder discharge ports 21 and 23 into silencer expansion chambers 17 and 19 then out of club head 3 through silencer discharge ports 21. Piston 93 and attached strike plate 87 move approximately 1.5 inches impacting the golf ball impelling ball down course.

Marshmellow spring snubber ring 105 and piston return spring 107 absorb the remaining energy of piston 93 before piston return spring 107 returns piston 93 back to ready position.

The flight of the golf ball is the very essence of the game and the judgement of distance is keenly observed and altered as the game is played. Golf ball flight variations are learned by a player thereby creating greater proficiency.

Ballistic impeller golf clubs are designed to drive a golf ball from twenty yards to 250 yards and achieve ball lofts equivalent to a number 1 "wood" or driver, a five iron and nine iron of conventional clubs. These equivalents are achieved by providing differing angles of strike plate 87. The ball's different driving ranges are achieved by changing the distance from the ball and the use of clubs with different strike plate and is. The purpose of the different strike plate angles is to allow a player to place the ball on the fairway or green at different vertical angles thereby creating better ball control and avoiding the skipping effect by altering the vertical angle at which the struck ball strikes the respective playing area.

The start of a golf game usually requires a drive to or toward the green and possible subsequent other shots before putting the ball into the hole depending on the length of the course. To achieve this process on longer holes, the club with the lowest face angle would be selected. The second shot, depending on the distance needed, could require a medium strike plate angle.

The next shot may be ten or fifteen yds. to the hole where the player would select a short range club with maximum strike plate angle and hold the club perhaps 1⅛ inches from the ball.

The final strokes would be accomplished with a conventional putter where one or more putts may be required depending on playing efficiency.

While the above description contains many details, the examples given should not be construed as limitations on the scope of the invention but merely as examples of preferred embodiments thereof. Additional advantages and modifications will readily occur to those skilled in the art. The invention in its broader aspects is therefore not limited to the specific details, representative apparatus and illustrative examples shown and described Accordingly, it should be apparent to those skilled in the art that variations and modifications are possible without departing from the spirit thereof.

I claim:

1. A ballistic impeller golf club of the type having:

(i) a club head with an exterior surface, a front face, a shaft having a first end and a second end affixed to said club head at said first end of said shaft and a handle affixed to said shaft at said second end of said shaft, said front face of said club head having a strike plate associated with said front face of said club head, said strike plate being rigidly affixed to a piston which is slideably supported within a piston cylinder formed within said club head, said piston cylinder having a forward end nearest said strike plate, said club head further having urging means comprising means for generating a gas under pressure by detonating an explosive charge effective to force said piston along said piston cylinder urging said attached strike plate away from said front face of said club head;

(ii) an explosive charge placement means having means for removably inserting and positioning for detonation said explosive charge within a breech chamber formed in said club;

(iii) a triggering means for detonating said explosive charge designed and arranged to be operated by hand of a person holding said handle of said golf club while operating said golf club;

wherein said explosive charge placement means comprises:

a cartridge holder means having a plurality of holes, each hole formed to hold a cartridge, said cartridge holder means insertable into said breech chamber;

a cam chamber formed within said club head adjacent to said breech chamber;

a cam means insertable into said cam chamber for locking said cartridge holder means in said club head when said cam means is oriented in a locking position and permitting said cartridge holder means to be separated from said club head when said cam means is in an unlocking position.

2. The club of claim 1 which further comprises:

said triggering means having a firing pin means for advancing and detonating an aligned one of said cartridges;

said cam means having a bore extending from one side to another side of said cartridge;

said cam means having said bore arranged in operable combination with said firing pin means to provide that, when said cartridge holder means holding said cartridges is inserted into said beech chamber and said cam means is oriented into said locking position and said said firing pin advances to detonate said cartridge, said firing pin means passes through said bore in said cam means and then detonates said cartridge and further providing that said cam means is fixed in said locking position until said firing pin is withdrawn to a safety position.

3. The club of claim 1 which comprises said cam means having a handle means for turning said cam between said locking and said unlocking position.

4. A ballistic impeller golf club of the type having:

(i) a golf club having a club head with an exterior surface, a front face, a shaft having a first end and a second end affixed to said club head at said first end of said shaft and a handle affixed to said shaft at said second end of said shaft, said front face of said club head having a strike plate associated with said front face of said club head, said strike plate being rigidly affixed to a piston which is slideably supported within a piston cylinder formed within said club head, said piston cylinder having a forward end nearest said strike plate, said club head further having urging means comprising means for generating a gas under pressure by detonating an explosive charge effective to force said piston along said piston cylinder urging said attached strike plate away from said front face of said club head;

(ii) an explosive charge placement means having means for removably inserting and positioning for detonation said explosive charge within a breech chamber formed in said club;

(iii) a triggering means for detonating said explosive charge designed and arranged to be operated by hand of a person holding said handle of said golf club while operating said golf club, wherein said triggering means comprises:

wherein said triggering means comprises:

a firing pin means activated by a firing pin spring means to detonate said charge when said firing pin means is released from a cocked position, a button means for releasing said firing pin means from said cocked position when said button means is depressed;

said button means being positioned on said handle and accessible to a user grasping said handle when addressing a golf ball;

three groves formed on a surface of said handle;

three balls, each ball rollably positioned in a respective one of said three grooves; providing that each one of said three balls is enabled to roll to/from one end of its respective groove from/to another end of said respective groove depending on orientation of said handle;

each groove having an end extending to a respective one of three unblocking locations operably positioned to provide that when all of said three balls are in their respective blocking locations, said button means is enabled to be depressed whereby said charge is detonated and when any one of said balls is not in said respective unblocking location, said any one of said balls will prevent depression of said button means whereby release of said firing pin is prevented;

each said groove being formed such that when said handle and said strike plate are oriented at an angle with the vertical direction that is less than a preselected angle, all of said balls are in said unblocking position permitting detonation of said charge and when at least one of said handle and said strike plate are oriented at an angle with said vertical direction that is greater than said preselected angle, at least one of said balls will be in said blocking position preventing detonation of said charge.

5. The club of claim 4 wherein said preselected angle is fifteen degrees.

6. A ballistic impeller golf club of the type having:

(i) a golf club having a club head with an exterior surface, a front face, a shaft having a first end and a second end affixed to said club head at said first end of said shaft and a handle affixed to said shaft at said second end of said shaft, said front face of said club head having a strike plate associated with said front face of said club head, said strike plate being rigidly affixed to a piston which is slideably supported within a piston cylinder formed within said club head, said piston cylinder having a forward end nearest said strike plate, said club head further having urging means comprising means for generating a gas under pressure by detonating an explosive charge effective to force said piston along said piston cylinder urging said attached strike plate away from said front face of said club head;

(ii) an explosive charge placement means having means for removably inserting and positioning for detonation said explosive charge within a breech chamber formed in said club;

(iii) a triggering means for detonating said explosive charge designed and arranged to be operated by hand of a person holding said handle of said golf club while operating said golf club, wherein said triggering means comprises:

a firing pin means activated by a firing pin spring means to detonate said charge when said firing pin means is released from a cocked position, a button means for releasing said firing pin means from said cocked position when said button means is depressed;

said button means being positioned on said handle and accessible to a user grasping said handle when addressing a golf ball;

three groves formed on a surface of said handle;

three balls, each ball rollably positioned in a respective one of said three grooves providing that each one of said three balls is enabled to roll in a direction between one end of its respective groove and another end of said respective groove depending on orientation of said handle;

each groove having an end extending to a respective one of three unblocking locations operably positioned to provide that when all of said three balls are in their respective blocking locations, said button means is enabled to be depressed whereby said charge is detonated and when any one of said balls is not in said respective unblocking location, said any one of said balls will prevent depression of said button means whereby release of said firing pin is prevented;

each said groove being formed such that when said handle and said strike plate are oriented at an angle with the vertical direction that is less than a preselected angle, all of said balls are in said unblocking position permitting detonation of said charge and when at least one of said handle and said strike plate are oriented at an angle with said vertical direction that is greater than said preselected angle, at least one of said balls will be in said blocking position preventing detonation of said charge; and wherein said explosive charge placement means comprises:

a cartridge holder means having a plurality of holes, each hole formed to hold a cartridge, said cartridge holder means insertable into said breech chamber;

a cam chamber formed within said club head adjacent to said breech chamber;

a cam means insertable into said cam chamber for locking said cartridge holder means in said club head when said cam means is oriented in a locking position and permitting said cartridge holder means to be separated from said club head when said cam means is in an unlocking position.

7. The club of claim 6 which further comprises:

said triggering means having a firing pin means for advancing and detonating an aligned one of said cartridges;

said cam means having a bore extending from one side to another side of said cartridge;

said cam means having said bore arranged in operable combination with said firing pin means to provide that, when said cartridge holder means holding said cartridges is inserted into said beech chamber and said cam means is oriented into said locking position and said firing pin advances to detonate said cartridge, said firing pin means passes through said bore in said cam means and then detonates said cartridge and further providing that said cam means is fixed in said locking position until said firing pin is withdrawn to a safety position.

* * * * *